US009150027B2

(12) United States Patent
Kikkawa

(10) Patent No.: US 9,150,027 B2
(45) Date of Patent: Oct. 6, 2015

(54) LIQUID SUPPLYING DEVICE, DROPLET DISCHARGE DEVICE, AND IMAGE FORMING APPARATUS

(71) Applicant: Fumitaka Kikkawa, Kanagawa (JP)

(72) Inventor: Fumitaka Kikkawa, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/554,586

(22) Filed: Nov. 26, 2014

(65) Prior Publication Data

US 2015/0151549 A1 Jun. 4, 2015

(30) Foreign Application Priority Data

Dec. 3, 2013 (JP) ..... 2013-250506

(51) Int. Cl.
*B41J 2/175* (2006.01)

(52) U.S. Cl.
CPC ..... *B41J 2/17596* (2013.01)

(58) Field of Classification Search
CPC ..... B41J 2/17596; B41J 2/17556
See application file for complete search history.

(56) References Cited

U.S. PATENT DOCUMENTS

| | | | | |
|---|---|---|---|---|
| 8,272,718 | B2 * | 9/2012 | Katoh et al. | 347/85 |
| 2011/0050816 | A1 | 3/2011 | Katoh et al. | |
| 2011/0134184 | A1 | 6/2011 | Katoh et al. | |
| 2011/0141167 | A1 | 6/2011 | Kikkawa et al. | |
| 2012/0033020 | A1 | 2/2012 | Kikkawa | |
| 2012/0236072 | A1 | 9/2012 | Kikkawa | |

FOREIGN PATENT DOCUMENTS

| | | |
|---|---|---|
| JP | 2004-351845 | 12/2004 |
| JP | 2005-262521 | 9/2005 |
| JP | 2010-274608 | 12/2010 |

* cited by examiner

*Primary Examiner* — Juanita D Jackson
(74) *Attorney, Agent, or Firm* — Cooper & Dunham LLP

(57) ABSTRACT

A liquid supplying device includes a liquid container detachably mountable to the container mount portion, a liquid supply channel to communicate with both the liquid container mounted in the container mount portion and a liquid supply target, a liquid feeder at a midway of the liquid supply channel to pressurize a liquid in the liquid supply channel to feed the liquid to the liquid supply target by pressurizing the liquid, a bypass channel connected to the liquid supply channel to bypass a portion of the liquid supply channel and communicate with both an upstream side and a downstream side of the liquid feeder in a liquid supply direction of the liquid supply channel, and a first valve in the bypass channel to close when the liquid container is mounted in the container mount portion and to open in response to detachment of the liquid container.

11 Claims, 12 Drawing Sheets

LIQUID SUPPLYING DEVICE, DROPLET DISCHARGE DEVICE, AND IMAGE FORMING APPARATUS

CROSS-REFERENCE TO RELATED APPLICATIONS

This patent application is based on and claims priority pursuant to 35 U.S.C. §119(a) to Japanese Patent Application No. 2013-250506, filed on Dec. 3, 2013, in the Japan Patent Office, the entire disclosure of which is hereby incorporated by reference herein.

BACKGROUND

1. Technical Field

Embodiments of the present disclosure relate to a liquid supplying device to which a liquid container can be detachably attached and a droplet discharge device and an image forming apparatus including the liquid supplying device.

2. Description of the Related Art

Image forming apparatuses are used as printers, facsimile machines, copiers, plotters, or multi-functional devices having, e.g., two or more of the foregoing capabilities. As one type of image forming apparatus, for example, an image forming apparatus is known that includes a liquid supplying device to supply ink to a droplet discharge head having nozzles from an ink cartridge detachably attachable to an apparatus body of the image forming apparatus.

Such an image forming apparatus may supply ink to a droplet discharge head by pressurizing ink using a liquid feed pump disposed in an ink supply passage that supplies ink to the droplet discharge head.

SUMMARY

In at least one embodiment of this disclosure, there is provided a liquid supplying device including a liquid container detachably mountable to the container mount portion, a liquid supply channel to communicate with both the liquid container mounted in the container mount portion and a liquid supply target, a liquid feeder at a midway of the liquid supply channel to pressurize a liquid in the liquid supply channel to feed the liquid to the liquid supply target by pressurizing the liquid, a bypass channel connected to the liquid supply channel to bypass a portion of the liquid supply channel and communicate with both an upstream side and a downstream side of the liquid feeder in a liquid supply direction of the liquid supply channel, and a first valve in the bypass channel to close when the liquid container is mounted in the container mount portion and to open in response to detachment of the liquid container.

In at least one embodiment of this disclosure, there is provided a droplet discharge device including a droplet discharge head including a nozzle to discharge droplets of a liquid, and the above-described liquid supplying device to supply the liquid to the droplet discharge head.

In at least one embodiment of this disclosure, there is provided an image forming apparatus including a droplet discharge head including a nozzle to discharge droplets of a liquid for image formation toward a recording medium, and the above-described liquid supplying device to supply the liquid for image formation to the droplet discharge head.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1A:
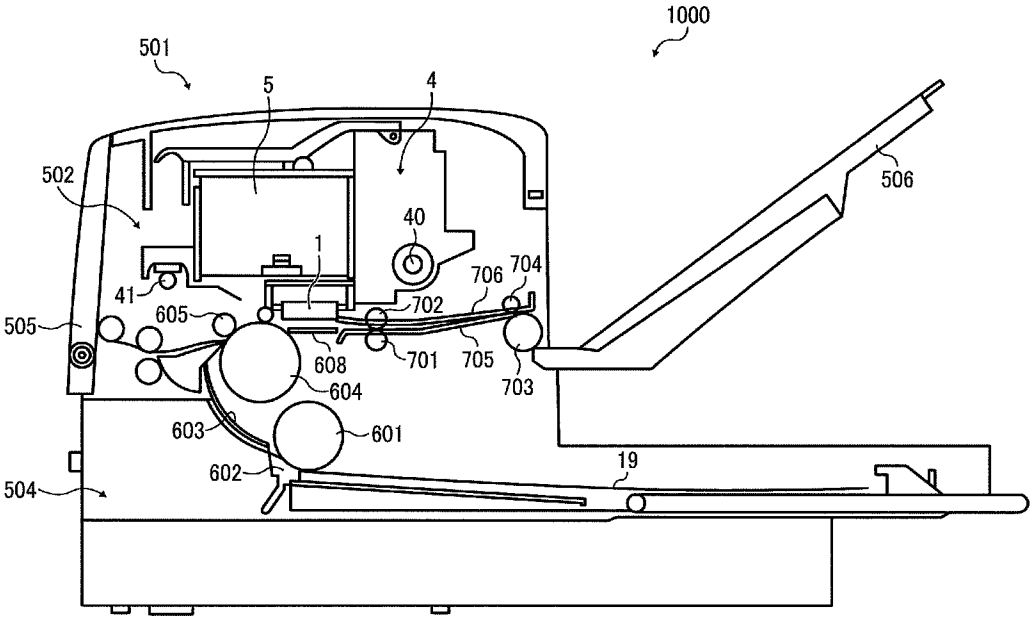
FIG. 1A is a schematic view of an internal configuration of an image forming apparatus according to at least one embodiment of the present disclosure that is seen from a lateral side thereof.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

In an image forming apparatus, when ink is fed to a droplet discharge head by pressurizing the ink using a pump disposed in an ink supply passage, a liquid disposed in a channel part disposed upstream from the pump in an ink supply direction may be sucked with the pump to cause a negative pressure in the channel part. When an ink cartridge is detached in such a state in which the channel part disposed upstream from the pump in the ink supply direction, in other words, a channel part between the pump disposed in the ink supply passage and the ink cartridge is in a negative pressure state as above, a pressure difference from the atmospheric pressure may cause the air to enter the channel part as bubbles. The bubbles entered as such may move to the inside of the ink supply passage and stay inside the droplet discharge head or a sub-tank communicating with the droplet discharge head. As a result, the droplet discharge performance of the droplet discharge head may be changed to degrade the image quality. For example, such bubbles staying inside the droplet discharge head or the sub-tank tend to expand when ambient environment is at high temperature and pressurizes the inside of the droplet discharge head or the sub-tank communicating with the droplet discharge head. As a result, the pressure inside the droplet discharge head may exceed the upper limit of a pressure range in which droplets can be discharged in a normal way, thus deteriorating the image quality.

In addition, such entering of air into the liquid supply passage at the time of detaching the liquid container may similarly occur also in the case of a liquid supplying device that supplies liquid other than ink.

In light of such circumferences, at least one embodiment of this disclosure provides a liquid supplying device capable of supplying liquid to a liquid supply target by pressurizing the liquid while suppressing entry of air into a liquid supply passage when a liquid container is detached.

Referring now to the drawings, embodiments of the present disclosure are described below. In the drawings for explaining the following embodiments, the same reference codes are allocated to elements (members or components) having the same function or shape and redundant descriptions thereof are omitted below.

Figure 1B:
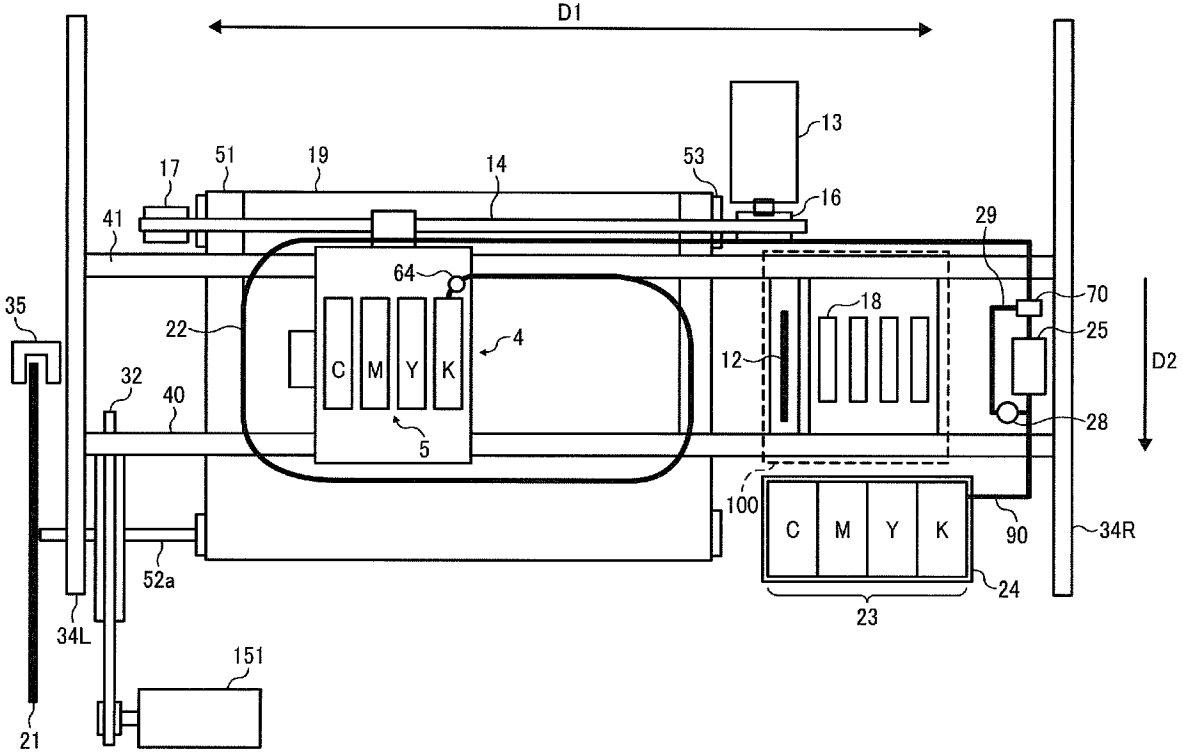
FIG. 1B is a schematic view of the internal configuration of the image forming apparatus of FIG. 1 seen from an upper side thereof.

Hereinafter, embodiments of the present disclosure are described with reference to the drawings. FIG. 1A is a schematic view of an internal configuration of an image forming apparatus (inkjet recording apparatus) according to an embodiment of the present disclosure, seen from a lateral side thereof. FIG. 1B is a schematic view of a configuration of the internal configuration of the image forming apparatus of FIG. 1A seen from an upper side thereof.

As illustrated in FIG. 1A, an image forming apparatus 1000 according to at least one embodiment houses, e.g., a printing assembly 502 inside an apparatus body 501. The printing assembly 502 includes, e.g., a carriage 4 movable in a main-scanning direction indicated by arrow D1 in FIG. 1B, an ink cartridge 23 serving as a liquid cartridge or container to supply ink, which is a liquid used for forming an image, to a recording head 1 serving as a droplet discharge head mounted in the carriage 4.

In a lower portion of the apparatus body 501, a sheet feeding cassette 504 (or sheet feeding tray) capable of loading sheets 19 as a plurality of recording media can be mounted to be freely inserted or extracted from the front side. In addition, a manual feed tray 505 used for manually feeding a sheet 19 may be thrown down and opened. A sheet 19 fed from the sheet feeding cassette 504 or the manual feed tray 505 is taken in and, after a desired image is recorded thereon by the printing assembly 502, the sheet 19 is ejected to a paper-ejection tray 506 mounted on a back face side of the apparatus body 501.

The printing assembly 502 holds a guide rail (main guide rod) 91 that is a guide member laterally bridged over left and right side plates, a guide rail (sub-guide rod) 41, and a carriage 4 to be slidable in the main-scanning direction indicated by arrow D1 in FIG. 1B.

The carriage 4 has a rear side (a downstream side in a sheet conveyance direction) fitted into the guide rail (main guide rod) 91 to be slidable and has a front side (an upstream side in the sheet conveyance direction) placed in the guide rail (sub-guide rod) 41 to be slidable. In order to allow the carriage 4 to move for scanning in the main-scanning direction D1, a timing belt 14 extends between a driving pulley 16 driven to rotate by a main scanning motor 13 and a driven pulley 17. In other words, the carriage 4 is moved for scanning by the main scanning motor 13 through the timing belt 14 that extends between the driving pulley 16 and the driven pulley 17. The timing belt 14 is fixed to the carriage 4, and the carriage 4 is driven to reciprocate according to forward and reverse rotation of the main scanning motor 13. Instead of the guide rails 40 and 41, a configuration may be employed in which the carriage is held to be slidable by sheet metal.

In the carriage 4, nozzles as a plurality of ink discharge ports are arrayed in a direction crossing the main-scanning direction D1, and multiple recording heads 1 are mounted so as to have a droplet discharge direction toward the lower side. The recording heads 1 are heads (inkjet heads) that discharge ink droplets of colors of yellow (Y), cyan (C), magenta (M), and black (Bk) and include nozzles to discharge the droplets of the colors. These nozzles are arrayed in a direction crossing the scanning direction of the carriage 4. As described above, in some embodiments, four recording heads 1 are used in accordance with the colors. In some embodiments, one recording head having a plurality of nozzles that discharge droplets of the colors is used.

As the recording head 1, a recording head is used that includes any one of various types of energy generator used for discharging ink (recording liquid) as a liquid in form of ink droplets. As such an energy generator, in some embodiments, a piezoelectric actuator such as a piezoelectric element, a thermal actuator using film boiling of a liquid by using an electro-thermal conversion element such as a heat generating resistant body, or the like is used. In some embodiments, as the energy generator, a shape memory alloy actuator using a metal phase change according to a change in temperature, an electrostatic actuator using an electrostatic force, or the like is used.

In the carriage 4, ink cartridges 23 as a plurality of liquid containers used for supplying liquids (ink) of colors to the recording heads 1 are mounted in an attachable/detachable manner (replaceable manner) relative to a cartridge holder 24 serving as a container mount portion of the apparatus body 501.

The carriage 4 also mounts sub-tanks 5 that temporarily store ink supplied from the ink cartridges 23 and stabilize the pressure of ink supplied to the recording heads 1. Each sub-tank 5 is integrally connected to a corresponding one of the recording head 1. Each sub tank 5 has a supply port to supply ink to the corresponding recording head 1 disposed on the lower side in FIG. 1A.

The ink cartridge 23 is attached to the apparatus body 501 for each color or for each ink (recording liquid). The ink cartridge 23 and the sub-tank 5 communicate with each other through a liquid supply tube 22 that is a member forming an ink supply channel as a liquid supply channel. Through this liquid supply tube 22, ink of each color is supplied from the ink cartridge 23 to the recording head 1. In addition, in the configuration example illustrated in FIG. 1B, while only one liquid supply tube 22 is illustrated, actually, the ink cartridge 23 communicates with the sub-tank 5 for each color.

The sub-tank 5 is a single body having a configuration in which supply passages are divided for each color, and the liquid supply tube 22 communicates with the sub-tank 5 for each color. In addition, in a configuration in which one sub-tank 5 communicates with only one type of ink, the liquid supply tube 22 is connected to each sub-tank 5. In the example illustrated in FIG. 1B, one sub-tank 5 is arranged for each color.

In the liquid supply tube 22, a diaphragm pump 25, which is a pressurizing pump as a liquid feeder used for supplying ink to the sub-tank 5 by pressurizing the ink stored in the ink cartridge 23, having high versatility is disposed.

In addition, between the diaphragm pump 25 and the sub-tank 5, a pressure chamber 70 as a relay chamber is disposed. In the pressure chamber 70, a flexible film having at least one side face that is transformable in accordance with the pressure stretches. A bypass channel 29 that allows a part of the pressure chamber 70 up to an upstream-side ink supply channel part 90, which allows the ink cartridge 23 and the diaphragm pump 25 to communicate with each other, to communicate with each other is disposed. In addition, in the bypass channel 29, a valve 28 is disposed.

Furthermore, according to at least one embodiment, in order to convey a sheet 19 set in the sheet feeding cassette 504 to the lower side of the recording head 1, the image forming apparatus 1000 includes a sheet feeding roller 601, a friction pad 602, a guide member 603, a conveyance roller 604, and a leading end roller 605. The sheet feeding roller 601 and the friction pad 602 separate and feed a sheet 19 from the sheet feeding cassette 504, and the guide member 603 guides the sheet 19. The conveyance roller 604 turns over and conveys the fed sheet 19. The leading end roller 605 defines the transport angle of the sheet 19 from the leading end roller 605 pressed to the peripheral face of the conveyance roller 604 and the conveyance roller 604. The conveyance roller 604 is driven to rotate through a gear train by a sub-scanning motor 151.

A print receiving member 608 serving as a sheet guide member is provided to guide the sheet 19 delivered from the conveyance roller 604 in accordance with the movement range of the carriage 4 in the main-scanning direction D1 on the lower side of the recording head 1. On the downstream side of the print receiving member 608 in the sheet conveyance direction are arranged a conveyance roller 701 and a spur roller 702 that are driven to rotate so as to deliver the sheet 19 in the paper ejecting direction. In addition, a paper ejection roller 703 and a spur roller 704 that deliver the sheet 19 to the paper-ejection tray 506 and guide members 705 and 706 that form a paper-ejection pathway are arranged.

In the image forming apparatus 1000 according to at least one embodiment, a maintenance unit to maintain and recover nozzle conditions of the recording heads 1 is arranged in a non-printing region at one side in the main scanning direction of the carriage 4. The maintenance unit includes a plurality of caps 18 used for capping ink discharge faces of the recording heads 1 so as to be moisturized, a wiper blade 12 that wipes the ink discharge faces, a dummy discharge receiving member, and the like. The dummy discharge receiving member receives ink, which increases in viscosity and does not contribute to printing, discharged from the recording head 1.

The maintenance unit prevents nozzle clogging by moisturizing the ink discharge face of the recording head 1 as follows. In a case where ink adhering to the ink discharge face of the recording head 1 is dried to lose moisture, the nozzle may be clogged. When the nozzle is clogged, ink droplets cannot be discharged from the nozzle so as to affect the image.

In order to prevent the nozzle clogging, for example, when the power is turned off or when a print job is not present, the carriage 4 is moved to a home position 100 illustrated in FIG. 1B, and the ink discharge face is capped by the cap 18. Thus, a moisturizing process is performed. In some embodiments, in a case where the ink adhering to the ink discharge face increases in viscosity so as to cause the nozzle to be clogged, the maintenance unit sucks the ink increasing in viscosity so as to be removed using a dedicated pump in a state in which the ink discharge face is capped.

In addition, at the home position 100 of the carriage 4, the wiper blade 12 that is used for forming a meniscus on the ink discharge face by wiping the ink adhering to the ink discharge face of the recording head 1 that discharges ink droplets is arranged. This wiper blade 12 projects out when the ink discharge face is wiped. Then, the carriage 4 scans toward the projecting wiper blade 12, and thus the ink discharge face is wiped.

As described above, in at least one embodiment, the wiper blade 12 wipes the ink discharge face in the scanning direction of the carriage for the ink discharge face. Alternatively, in some embodiments, the wiper blade 12 wipes the ink discharge face in a sub-scanning direction indicated by arrow D2.

In the image forming apparatus 1000 having the above-described configuration, image formation (printing) is performed, for example, as follows. First, a sheet 19 as a recording medium set in the sheet feeding tray is conveyed while being held by the conveyance belt 51. When the sheet 19 passes through a recording region of the recording head 1, the carriage 4 performs scanning, whereby printing is performed. In the carriage 4, an encoder sensor that reads the pattern of an encoder scale attached between both side plates 34L and 34R along the main-scanning direction D1 is disposed. The position of the carriage 4 is detected with the encoder scale and the encoder sensor. When the carriage 4 performs scanning, by driving the actuator of the recording head 1 in accordance with an image signal, ink droplets are discharged onto the sheet 19 that is stopped. After printing for a predetermined row is performed through the scanning of the carriage 4, and the sheet 19 is conveyed by a predetermined amount, printing for the next row is performed, and the sheet 19 for which recording has been completed is ejected to the paper-ejection tray 506. When the printing is completed, the sheet 19 is ejected to the paper-ejection tray 506.

Figure 2:
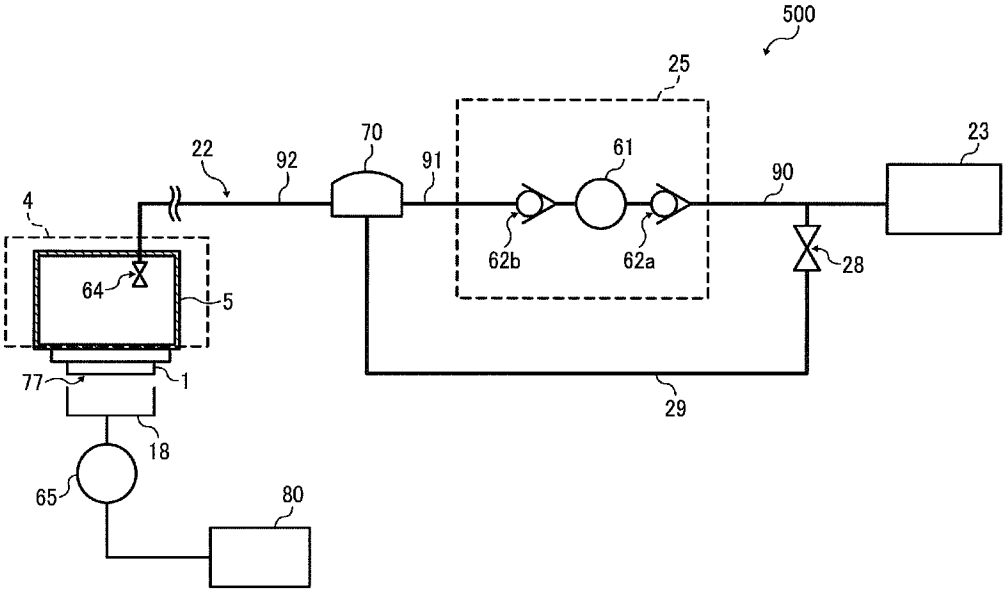
FIG. 2 is a schematic view of a liquid supplying device according to at least one embodiment of the present disclosure.

FIG. 2 is a schematic view of a configuration of a liquid supplying device (ink supplying system) 500 according to at least one embodiment of the present disclosure. In FIG. 2, the liquid supply tube 22 is a member that forms a liquid supply channel communicating with the ink cartridge 23 mounted in the cartridge holder 24 as the container mount portion and the recording head 1 that is a liquid supply target. The liquid supply tube 22 allows the ink cartridge 23 up to the sub-tank 5 to communicate with each other. Since the sub-tank 5 and the recording head 1 are integrally attached together, substantially, an ink supply channel as a liquid supply channel allowing the ink cartridge 23 up to the recording head 1 to communicate with each other is formed by the liquid supply tube 22.

In addition, to one side face portion of the sub-tank 5, a flexible film is attached.

Furthermore, between the ink cartridge 23 and the recording head 1 in the ink supply channel formed by the liquid supply tube 22, the diaphragm pump 25 having high versatility as a liquid feeder is attached.

The diaphragm pump 25 includes a diaphragm body 61, a check valve 62*a* disposed on the input side as a first check valve, and a check valve 62*b* disposed on the output side as a second check valve. The diaphragm body 61 has a liquid inlet port and a liquid outlet port and is a member having a hollow case shape that is surrounded by a wall portion which is at least partially formed by a flexible film. The check valve 62*a* is disposed on the liquid outlet port side of the diaphragm body 61 and opens the channel only in a direction in which ink is output from the diaphragm body 61. The check valve 62*b* is disposed on the liquid outlet port side of the diaphragm body 61 and opens the channel only in a direction in which ink is output from the diaphragm body 61. In addition, the diaphragm pump 25, as will be described later, further includes an urging unit that urges the flexible film of the diaphragm body 61 in a direction in which the flexible film is stretched.

Between the diaphragm pump 25 and the sub-tank 5 in the ink supply channel formed by the liquid supply tube 22, the pressure chamber 70 as a relay chamber having one side face portion to which the flexible film is attached is arranged.

In addition, the bypass channel 29 is disposed so as to bypass a portion of the ink supply channel formed by the liquid supply tube 22 in which the diaphragm pump 25 is disposed. The bypass channel 29 allows the pressure chamber 70 up to the upstream-side ink supply channel part 90, which is a part of the ink supply passage allowing the ink cartridge 23 and the diaphragm pump 25 to communicate with each other, to communicate with each other.

In the bypass channel 29, the valve 28 is disposed. The valve 28 is closed when the ink cartridge 23 is attached to the apparatus body 501 of the image forming apparatus 1000, and the valve 28 is open when the ink cartridge 23 is detached from the apparatus body 501 of the image forming apparatus 1000. As the valve 28, in some embodiments, a solenoid valve is used to detect the extraction of the ink cartridge 23 and opens/closes the bypass channel 29. However, the valve is not limited to the solenoid valve and any other valve may be used.

In addition, in an end portion of the liquid supply tube 22 extending to the inside of the sub-tank 5, a valve 64 is disposed. At a normal time when ink is discharged, the valve 64 is closed. On the other hand, only when pressure (negative pressure) of ink disposed in the channel extended from the sub-tank 5 to the recording head 1 is lowered, the valve 64 is opened, and ink pressurized by the diaphragm pump 25 is filled inside the sub-tank 5. As a result, the pressure of the ink that has been lowered in accordance with the droplet discharge of the recording head 1 is returned to predetermined pressure to be constant. The operation of the valve 64 is described later.

The cap 18 is disposed so as to prevent the drying of the droplet discharge face (nozzle face) 77 of the recording head 1. In a case where ink adhering to the droplet discharge face 77 increases in viscosity and clogs nozzles, the ink is sucked using a suction pump 65 in the state in which the droplet discharge face 77 is capped, whereby the nozzle clogging is resolved. The ink sucked using the suction pump 65 is accumulated in a waste-liquid tank 80.

Figure 3A:
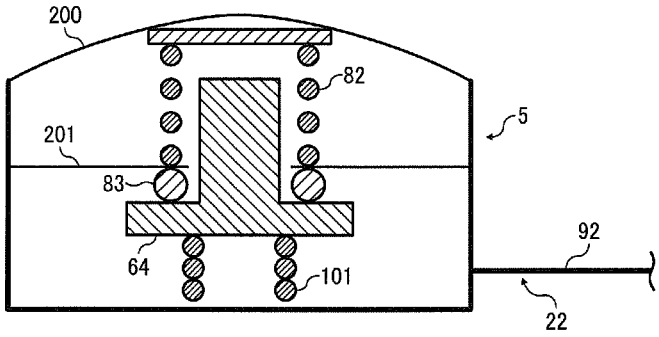
FIGS. 3A and 3B are schematic views of opening/closing operations of a valve disposed inside a sub-tank of a liquid supplying device according to at least one embodiment of the present disclosure.
Figure 3B:
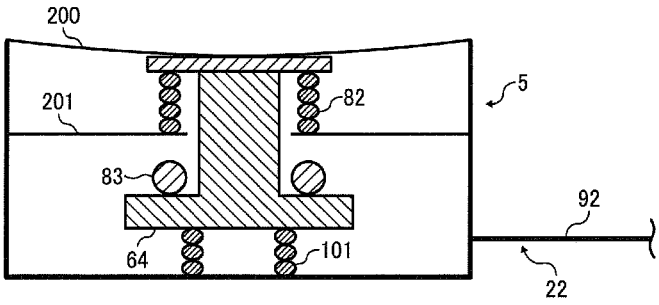

FIGS. 3A and 3B are schematic views of opening/closing operations of the valve 64 disposed inside the sub-tank 5 of the liquid supplying device 500 according to at least one embodiment of the present disclosure. As illustrated in FIG. 3A, a flexible film 200 stretching to the sub-tank 5 is recessed as illustrated in FIG. 3B as the negative pressure of the inside increases in accordance with ink discharge from the recording head 1. The recessed flexible film 200 receives an urging force according to a spring 101 as an urging unit and pushes out the valve 64 that has been normally closed. Then, a sealing member 83 temporarily disposed in the valve 64 is separated away from a wall face 201 to be opened, and the ink pressurized by the diaphragm pump 25 is supplied. When the pressure of the inside of the sub-tank 5 increases as the ink is supplied to the sub-tank 5, the flexible film swells up, and the valve 64 is moved depending on a force according to the spring 101 and is closed again. As described above, in at least one embodiment, the valve 64 is disposed inside the sub-tank 5. However, the position of the valve 64 and the opening/closing mechanism are not limited those of the above-described configuration.

Figure 4:
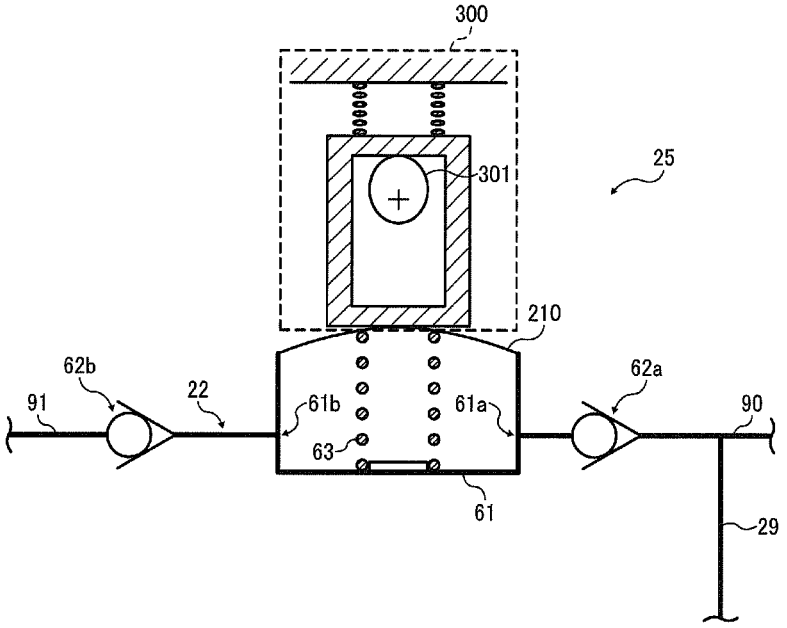
FIG. 4 is a schematic view of a configuration of a diaphragm pump of a liquid supplying device according to at least one embodiment of the present disclosure.

FIG. 4 is a schematic view of a configuration of the diaphragm pump 25 of the liquid supplying device 500 according to at least one embodiment of the present disclosure.

As illustrated in FIG. 4, the diaphragm pump 25 includes the diaphragm body 61, the check valve 62*a* disposed on the input side as the first check valve, the check valve 62*b* disposed on the output side as the second check valve, and a spring 63 as an urging unit. The diaphragm body 61 has the liquid inlet port 61*a* and the liquid outlet port 61*b* and, at least a part thereof is formed by a flexible film 210. The spring 63 urges the flexible film 210 from the inside of the diaphragm body 61 toward the outside thereof. In addition, ink is delivered only in a direction from the ink cartridge 23 toward the recording head 1 by the check valve 62*a* disposed on the input side and the check valve 62*b* disposed on the output side. Furthermore, the bypass channel 29 is connected to the upstream-side ink supply channel part 90 between the check valve 62*a* of the diaphragm pump 25 and the ink cartridge 23.

In addition, a cam unit 300 is disposed to be in contact with the flexible film 210 of the diaphragm body 61. As a cam 301 disposed in the cam unit 300 pushes the flexible film 210 to the inside of the diaphragm body 61, the ink pressure of the inside of the diaphragm body 61 increases, and the ink is delivered through the check valve 62*b*. In addition, when the cam unit 300 becomes separate away from the flexible film 210 in accordance with the rotation of the cam 301, the flexible film 210 swells up to the outer side in accordance with the spring 63. At this time, since the inside of the diaphragm body 61 is in a negative pressure state, the ink flows in from the ink cartridge 23 through the check valve 62*a*. The ink is pressurized by the operation of the diaphragm pump 25 as above and can be delivered toward the recording head 1.

Here, the configuration of the diaphragm pump 25 for pressurizing the flexible film 210 is not limited to the cam unit 300 illustrated in the configuration example represented in FIG. 4. In addition, while the material of the flexible film 210 is composed using a rubber material such as ethylene propylene diene monomer (EPDM) rubber, the present disclosure is not limited thereto. In addition, the flexible film 210 has a resistance against ink and strength for the cam unit 300, and a material satisfying the resistance and the strength may be used.

Figure 5:
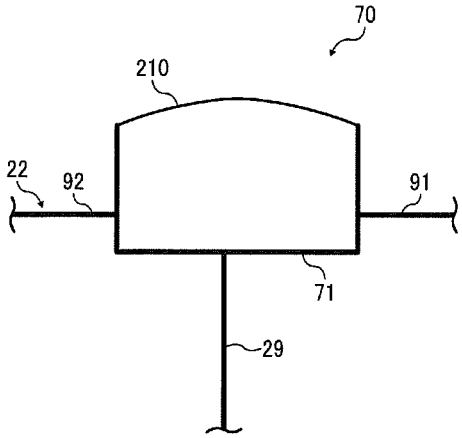
FIG. 5 is a schematic view of a configuration of a pressure chamber of a liquid supplying device according to at least one embodiment of the present disclosure.

FIG. 5 is a schematic view of an example of the configuration of the pressure chamber 70 of the liquid supplying device 500 according to at least one embodiment of the present disclosure. As illustrated in FIG. 5, a case 71 of a body of the pressure chamber 70 is disposed to relay an intermediate ink supply channel part 91 forming a part of the ink supply channel allowing the diaphragm pump 25 and the recording head 1 to communicate with each other and a downstream-side ink supply channel part 92. In addition, the bypass channel 29 is connected to a part of the case 71, whereby the case 71 and the bypass channel 29 communicate with each other. On one side wall portion of the pressure chamber 70, the flexible film 210 that is transformable in accordance with pressure is formed. As the material of the flexible film 210, a material having a small film thickness may be used so as to be easily transformed in accordance with the pressure, and, for example, a film may be preferably used.

Figure 6A:
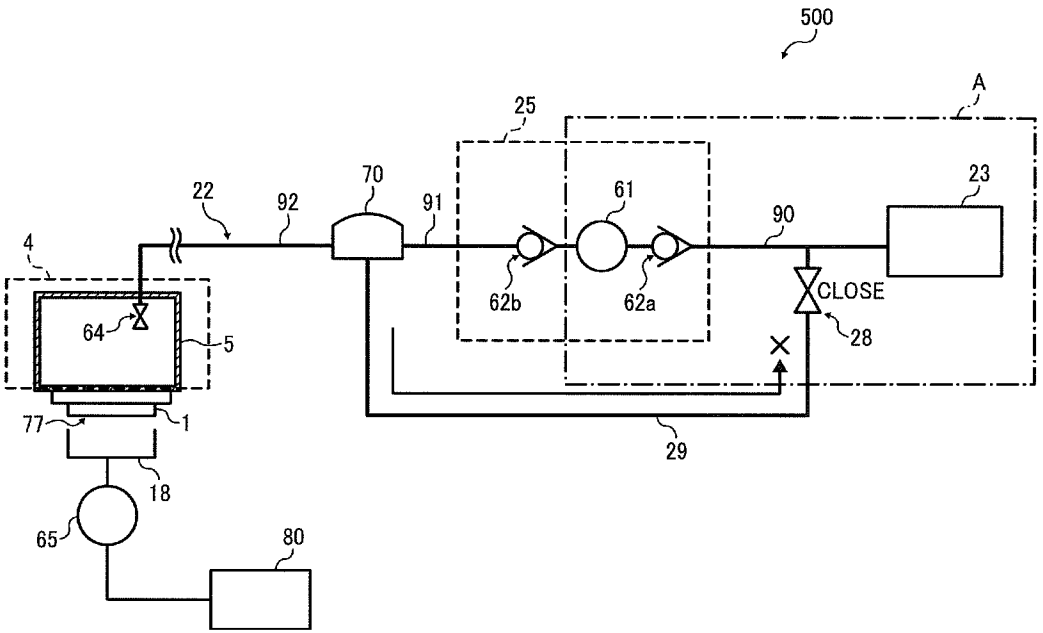
FIGS. 6A and 6B are schematic views of a liquid supplying device according to at least one embodiment of the present disclosure, with a principle that bubbles (air) are not mixed in when an ink cartridge is detached.
Figure 6B:
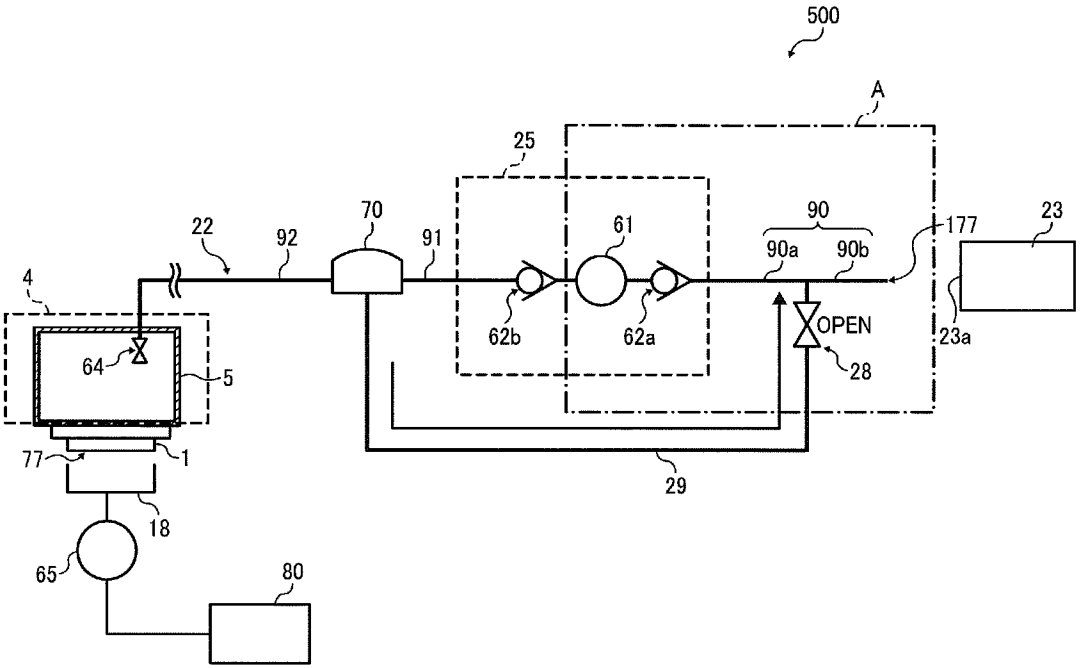

FIGS. 6A and 6B are schematic views of a liquid supplying device 500 according to at least one embodiment of the present disclosure, with a principle that bubbles (air) are not mixed in when the ink cartridge 23 is detached. FIG. 6A illustrates a state before the ink cartridge 23 is detached in a non-image forming operation state (non-printing state) of the recording head 1 in the liquid supplying device 500 according to at least one embodiment of the present disclosure. When the amount of the ink stored in the ink cartridge 23 decreases, negative pressure of an area A surrounded by dashed lines in FIG. 6A increases in accordance with the driving according to the diaphragm pump 25. At this time, since the recording head 1 is in the non-image forming operation state (non-printing state), the valve 64 is closed. Accordingly, the intermediate ink supply channel part 91 from the diaphragm pump 25 to the recording head 1, the downstream-side ink supply channel part 92, and the pressure chamber 70 are maintained to be in positive pressure according to the driving of the diaphragm pump 25. In addition, since the valve 28 disposed in the bypass channel 29 is closed, the inside of a portion from the pressure chamber 70 of the bypass channel 29 to the valve 28 is maintained to be in positive pressure as well.

When the ink cartridge 23 is pulled out to be detached in the state illustrated in FIG. 6A described above, as illustrated in FIG. 6B, the valve 28 is opened in accordance with an operation of detaching the ink cartridge 23. As a result, the pressure of the pressure chamber 70, which is positive pressure, propagates to the upstream-side ink supply channel part 90 disposed in the area A to be balanced. Accordingly, excessive negative pressure in the area A in FIG. 6B decreases, whereby mixing-in of the air (bubbles) that is at the atmospheric pressure from a communication port 177 as a liquid receiving port of the upstream-side ink supply channel part 90 to which a liquid ejection port 23*a* of the ink cartridge 23 is connected can be prevented.

In addition, when the valve 28 of the bypass channel 29 is opened, the pressure propagates from the pressure chamber 70 to the area A, and the ink disposed in the pressure chamber 70 flows in the upstream-side ink supply channel part 90 in accordance with a pressure difference between the area A and the upstream-side ink supply channel part 90. Here, out of the upstream-side ink supply channel part 90, a portion disposed further on the communication port 177 side than a position of connection with the bypass channel 29 will be referred to as a communication port-side ink supply channel part 90*b*, and a portion disposed further on the diaphragm pump 25 side than the position of connection with the bypass channel 29 will be referred to as a pump-side ink supply channel part 90*a*. By configuring the diameter of the communication port 177 to be small, in a case where the channel resistance of the communication port-side ink supply channel part 90*b* is higher than that of the pump-side ink supply channel part 90*a*, ink can flow into the diaphragm pump 25 without leaking from the communication port 177. Accordingly, a cartridge holder 24, which has an insertion port or the like in which the ink cartridge 23 is mounted, of the apparatus body 501 of the image forming apparatus 1000 does not get dirty.

A container attachment/detachment detecting unit that detects whether or not the ink cartridge 23 is mounted (inserted) in the cartridge holder 24 of the apparatus body side of the image forming apparatus 1000 may be configured by using various sensors such as an optical sensor and the like. The valve 28 may be controlled so as to be opened or closed based on detection information of the container attachment/detachment detecting unit. A control unit that controls the valve 28, for example, may be configured by a controller that is configured by a central processing unit (CPU), a memory, and the like. As a specific example of the valve 28, a configuration may be employed in which the bypass channel 29 having flexibility is crushed to be opened or closed using a solenoid valve.

Figure 7A:
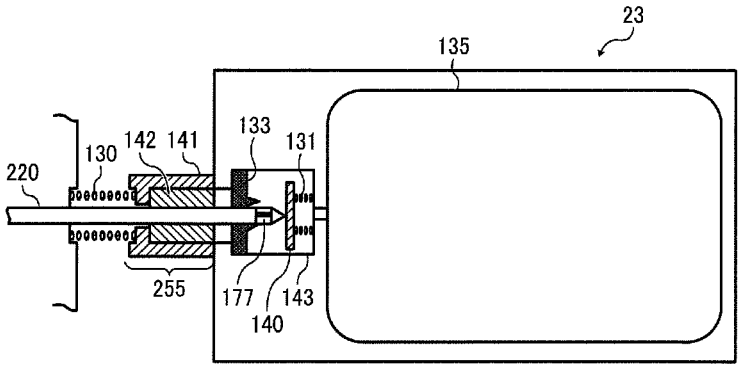
FIGS. 7A and 7B are schematic views of a configuration example and operation of a sealing unit that closes a communication port in response to attachment/detachment (insertion/removal) of an ink cartridge according to at least one embodiment of the present disclosure.
Figure 7B:
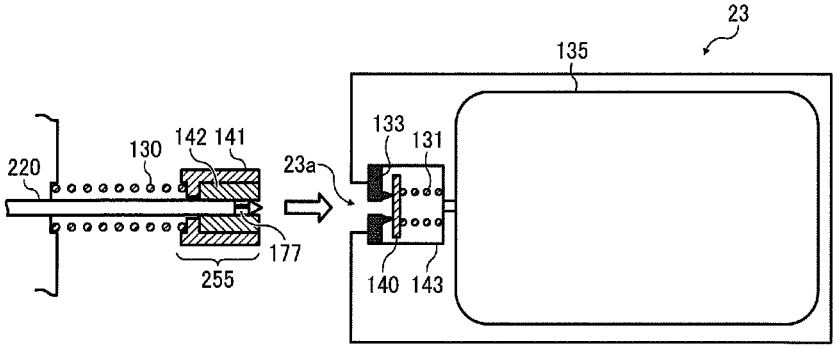

FIGS. 7A and 7B are schematic views of a configuration example and operation of a sealing unit that closes the communication port 177 according to attachment/detachment (insertion/removal) of the ink cartridge 23.

As described above with reference to FIG. 6B, the valve 28 is opened in accordance with the detachment of the ink cartridge 23, and the pressure of the pressure chamber 70, which is positive pressure, propagates to the upstream-side ink supply channel part 90 disposed in the area A so as to be balanced. At this time, when the pressure propagates from the pressure chamber 70 to the area A, ink flows in the upstream-side ink supply channel part 90 in accordance with a pressure difference, but, by increasing the channel resistance by decreasing the diameter of the communication port 177, the ink can be prevented from leaking from the communication port 177. However, for example, when the pressure of the pressure chamber 70 is high, or when the image forming apparatus 1000 is put in a high-temperature environment and the ink viscosity is low, there is concern that the ink leaks from the communication port 177. In other words, there is concern that ink flowing in the upstream-side ink supply channel part 90 in accordance with the detachment operation of the ink cartridge 23 may leak out from the communication port 177. In a case where the ink leaks out from the communication port 177, the periphery of the cartridge holder 24 in which the ink cartridge 23 is mounted is contaminated by the ink, and, in some cases, a user's hand in contact with the exterior of the ink cartridge 23 gets dirty. Accordingly, it is necessary to reliably seal the communication port 177 when the ink cartridge 23 is detached.

FIG. 7A illustrates a state in which the ink cartridge 23 is mounted in the apparatus body 501 of the image forming apparatus 1000. Inside the ink cartridge 23, an ink bag 135 in which ink is stored is disposed, and the ink stored inside the ink bag 135 communicates with a sealing chamber 143. Inside the sealing chamber 143, a sealing member 133 is disposed so as to prevent the ink stored in the sealing chamber 143 from leaking out through an external gap of a needle 220. The sealing member 133 is preferably an elastic body. In addition, in order to acquire seal performance even in a case where the position of the axial center of the sealing member 133 and position of the axial center of the needle 220 are deviated from each other in accordance with assembly variations between the needle 220 and the ink cartridge 23, it is preferable that the sealing member 133 have low hardness.

A pressing plate 140 is brought into contact with the leading end of the needle 220 by receiving a spring force of a spring 131 as an urging unit. In addition, a sealing unit 255 that is slidable on the outer circumferential surface of the needle 220 is disposed. The sealing unit 255 includes a slider 141, a sealing member 142, and a slide spring 130. The slider 141 is formed integrally with the sealing member 142 and is slidable in the same direction as the attachment/detachment direction (insertion/removal direction) of the ink cartridge 23 with the needle 220 being used as a guide. In addition, the slide spring 130 urges the slider 141, and the urging force is highest when the ink cartridge 23 is mounted in the apparatus body 501 of the image forming apparatus 1000. As can be understood from FIG. 7A, when the ink cartridge 23 is mounted, the sealing unit 255 is in a state of abutting the end face of the ink cartridge 23.

In addition, since the sealing member 142 has a sealing function for preventing ink leakage by closing the communication port 177, the sealing member 142 is preferably an elastic body. Furthermore, since the sealing member 142 slides with being in contact with the surface of the needle 220, it is preferable that a process of lowering the friction coefficient of the surface or a coating process be performed for the face of the sealing member 142 that is in contact with the needle 220.

FIG. 7B illustrates a state in which the ink cartridge 23 illustrated in FIG. 7A is detached from the apparatus body 501 of the image forming apparatus 1000. When the ink cartridge 23 is detached from the apparatus body 501 of the image forming apparatus 1000, the slider 141 and the sealing member 142 move to the leading end side of the needle 220 in accordance with the urging force of the slide spring 130. Then, when the ink cartridge 23 is completely detached from the apparatus body 501 of the image forming apparatus 1000, the sealing unit 255 stops at the leading end of the needle. At this time, the communication port 177 is sealed by the sealing member 142, and thereafter, the valve 28 is opened. Accordingly, the ink is prevented from leaking from the communication port 177 when the ink cartridge 23 is detached.

When the leading end of the needle 220 becomes separated away from the ink cartridge 23, the pressing plate 140 disposed in the sealing chamber 143 abuts the sealing member 133 in accordance with the force of the spring 131. Accordingly, the ink stored inside the ink cartridge 23 is prevented from overflowing to the outside.

Figure 8:
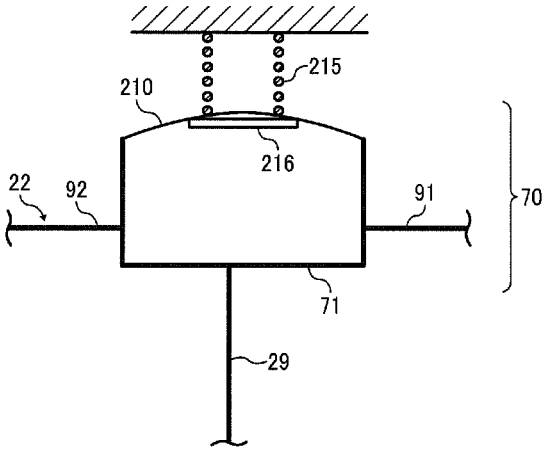
FIG. 8 is a schematic view of another configuration example of the pressure chamber of the liquid supplying device according to at least one embodiment of the present disclosure.

FIG. 8 is a schematic view of another configuration example of the pressure chamber 70 of the liquid supplying device 500 according to at least one embodiment of the present disclosure.

As illustrated in FIG. 5 described above, one side wall portion of the case 71 of the body of the pressure chamber 70 is formed by the flexible film 210. In this configuration example, a spring 215 is arranged as an urging unit that urges the flexible film 210 in the inward direction of the case 71. Since the spring 215 applies a force in a direction in which the flexible film 210 is recessed, the positive pressure of the inside of the pressure chamber 70 can be raised. Accordingly, when the ink cartridge 23 is detached so as to open the valve 28 due to running out of ink, a difference from the negative pressure occurring in the upstream-side ink supply channel part 90 can be increased. Thus, even when the image forming apparatus 1000 is put in a low-temperature environment, and the ink viscosity increases, a pressure difference above a pressure loss of ink flowing into the bypass channel 29 can be secured by opening the valve 28. Accordingly, the positive pressure of the pressure chamber 70 is reliably delivered to the upstream-side ink supply channel part 90, and the negative pressure of the inside of the upstream-side ink supply channel part 90 can be alleviated. Accordingly, it can be prevented that the air at the atmospheric pressure is mixed in from the communication port 177 of the upstream-side ink supply channel part 90 that is opened by detaching the ink cartridge 23.

Figure 9A:
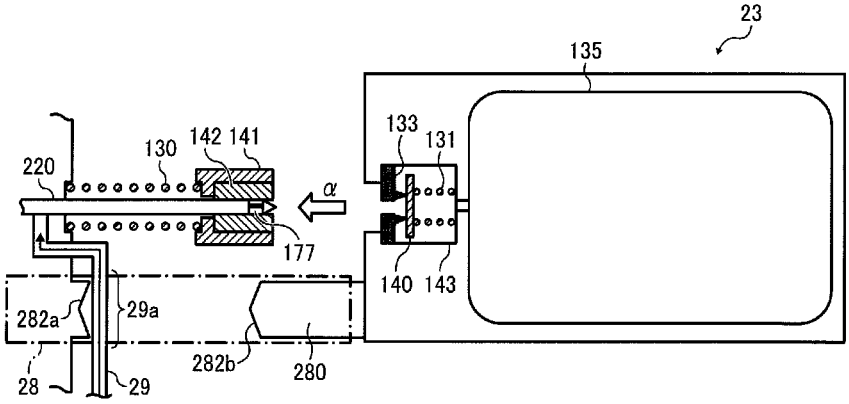
FIGS. 9A and 9B are schematic views of another configuration example and operation of a valve of a bypass channel of the liquid supplying device according to at least one embodiment of the present disclosure.
Figure 9B:
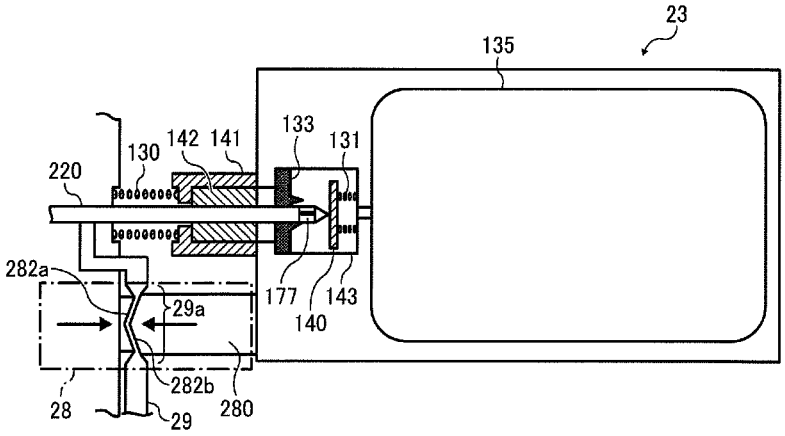

FIGS. 9A and 9B are schematic views of another configuration example and operation of the valve 28 of the bypass channel 29 of the liquid supplying device 500 according to at least one embodiment of the present disclosure. The valve 28 may be configured by a solenoid valve or the like that is controlled by detecting the insertion state of the ink cartridge 23 so as to be opened or closed in accordance with the attachment/detachment operation (insertion/removal operation) of the ink cartridge 23 as described above. However, in such a case, the cost of the image forming apparatus increases. In this configuration example, when the ink cartridge 23 is mounted, a body part of the ink cartridge 23 opens or closes the bypass channel 29.

FIG. 9A illustrates a state before the ink cartridge 23 is attached to the apparatus body 501 of the image forming apparatus 1000. On the end face of the ink cartridge 23 that is disposed on the cartridge holder side, a projection 280 is arranged, and a closing portion 282*b* is formed at the leading end of the projection 280. In addition, in a cartridge holder 24 in which the ink cartridge 23 is housed, a closing receiving portion 282*a* having the same surface shape as the closing portion 282*b* is arranged. The bypass channel 29 is disposed so as to pass between the closing portion 282*b* and the closing receiving portion 282*a*, and a portion between the closing portion 282*b* and the closing receiving portion 282*a* in the bypass channel 29 is a flexible channel (elastic channel) 29*a*. The valve 28 is configured by the closing receiving portion 282*a* disposed on the cartridge holder side and the closing portion 282*b* disposed on the ink cartridge 23 side.

FIG. 9B illustrates a state in which the ink cartridge 23 is attached to the apparatus body 501 of the image forming apparatus 1000. In order to attach the ink cartridge 23 to the apparatus body 501 of the image forming apparatus 1000 from the state illustrated in FIG. 9A, when the ink cartridge 23 is inserted into the cartridge holder 24, the ink cartridge 23 is slid in one direction by a guide disposed in the cartridge holder 24. Then, the flexible channel (elastic portion) 29*a* of the bypass channel 29 disposed between the closing portion 282*b* and the closing receiving portion 282*a* is interposed therebetween so as to be crushed. Accordingly, the bypass channel 29 that has been opened until now is in the closed state by attaching the ink cartridge 23. In other words, the closing portion 282*b* and the closing receiving portion 282*a* have the function of the valve 28. As above, by employing a configuration in which the bypass channel 29 is closed by the ink cartridge 23, the valve 28 that can be opened or closed in accordance with the detachment of the ink cartridge 23 can be arranged without incurring complexity and high cost.

In addition, when the ink cartridge 23 is attached to the image forming apparatus 1000 once, the state is maintained However, the shapes of the closing portion 282*b* and the closing receiving portion 282*a* are not limited to those of the configuration example illustrated in FIGS. 9A and 9B, and any shapes that can reliably crush the flexible channel (elastic portion) 29*a* of the bypass channel 29 may be used.

Furthermore, when the ink cartridge 23 is detached from the state illustrated in FIG. 9B, it is preferable that the closing portion 282*b* be separated away from the closing receiving portion 282*a* before the ink cartridge 23 is detached. In such a configuration, the bypass channel 29 is opened before the detachment of the ink cartridge 23. Thus, the positive pressure of the pressure chamber 70 propagates to the upstream-side ink supply channel part 90 disposed between the ink cartridge 23 and the diaphragm pump 25, whereby the negative pressure can be negated. When the ink cartridge 23 is extracted thereafter, the air (bubbles) can be more reliably prevented from being mixed into the upstream-side ink supply channel part 90.

Figure 10:
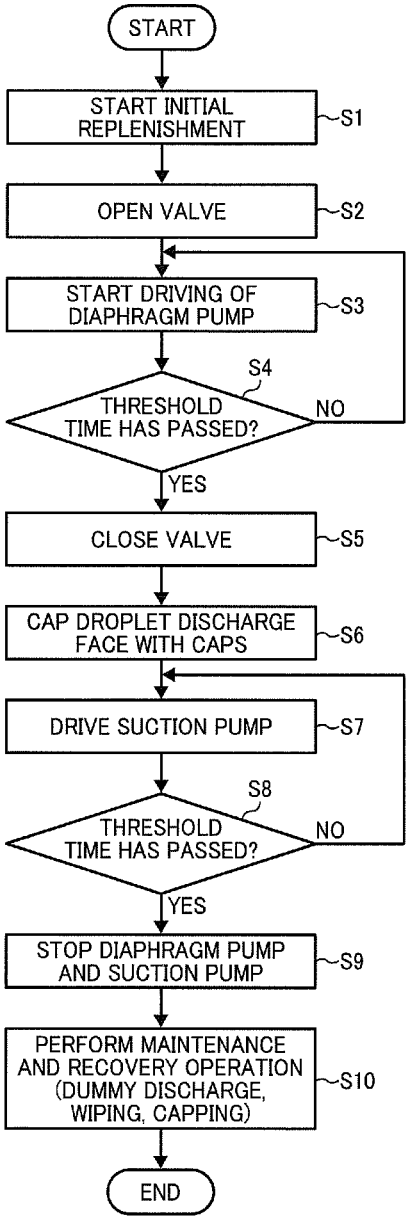
FIG. 10 is a flowchart of an example of an initial filling sequence for filling with ink the bypass channel of the liquid supplying device according to at least one embodiment of the present disclosure.

FIG. 10 is a flowchart of an example of an initial filling sequence for filling with ink the bypass channel 29 of the liquid supplying device 500 according to at least one embodiment of the present disclosure.

In the liquid supplying device 500 according to at least one embodiment, the bypass channel 29 is formed from the pressure chamber 70, bypasses the diaphragm pump 25, and communicates with the upstream-side ink supply channel part 90. When the image forming apparatus 1000 is used for the first time, the bypass channel 29 is not filled with ink but filled with the air or a filling liquid. Here, in a case where the inside of the bypass channel 29 is filled with the air, the air originated from the atmosphere is prevented from entering the upstream-side ink supply channel part 90, and accordingly, when the valve 28 is opened, the air disposed inside the bypass channel 29 enters the upstream-side ink supply channel part 90. On the other hand, in a case where the inside of the bypass channel 29 is filled with the filling liquid, when the valve 28 is opened, the filling liquid is mixed into ink remaining in the upstream-side ink supply channel part 90 and has an adverse effect on an image formed using the ink. Thus, according to the sequence illustrated in FIG. 10, at the time of the initial filling process, the inside of the bypass channel 29 is securely filled with ink.

As illustrated in FIG. 10, when the initial filling sequence is started, first, the valve 28 is opened in Steps S1 and S2. Then, the diaphragm pump 25 is driven in Step S3. At this time, since the valve 64 disposed in the downstream-side ink supply channel part 92 is closed, the intermediate ink supply channel part 91 and the downstream-side ink supply channel part 92 that are formed from the diaphragm pump 25 to the recording head 1 are closed. Accordingly, in accordance with the driving of the diaphragm pump 25, ink passes through the bypass channel 29 from the pressure chamber 70 and is returned to the diaphragm pump 25 again to be circulated. In accordance with this circulation operation, the air (bubbles) disposed in the bypass channel 29 is collected into the inside of the diaphragm pump 25 or the inside of the pressure chamber 70 by buoyancy. After a predetermined time elapses (Yes in Step S4), the valve 28 is closed, and the droplet discharge face of the recording head 1 is capped in Steps S5 and S6. Then, by driving the suction pump 65, the air collected on the inside of the diaphragm pump or the inside of the pressure chamber 70 is extracted from the droplet discharge face of the recording head 1 in Step S7. At this time, since the valve 28 is closed, the air does not flow into the bypass channel 29. In addition, in a case where the inside of the bypass channel 29 is filled with the filling liquid in advance, when the bypass channel 29 is filled with the ink, the ink is mixed with the filling liquid. However, the mixed ink is discharged from the droplet discharge face at the timing of driving the suction pump 65. After a predetermined time elapses (Yes in Step S8), the driving of the diaphragm pump 25 and the driving of the suction pump 65 are stopped, and a maintenance and recovery operation is performed in Steps S9 and S10.

By performing the initial filling sequence illustrated in FIG. 10, the air or the air and the filling liquid disposed inside the bypass channel 29 is removed, and the bypass channel 29 can be filled with the ink. Thus, by delivering the positive pressure from the pressure chamber 70 to the upstream-side ink supply channel part 90 and securely alleviating the negative pressure of the inside of the upstream-side ink supply channel part 90, the mixing-in of the air can be prevented. In addition, the degradation of the image quality due to the mixing of the filling liquid filled in the bypass channel 29 in advance into the ink used for image formation can be prevented.

Figure 11:
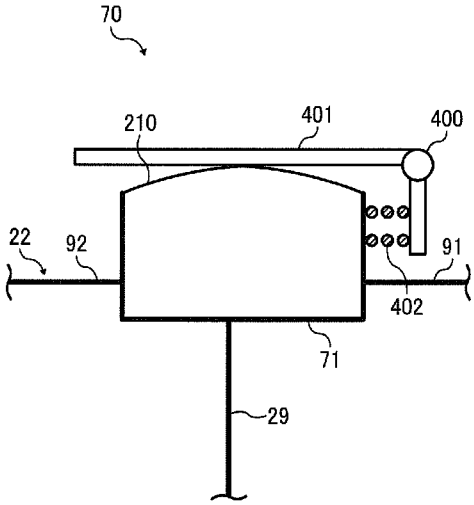
FIG. 11 is a schematic view of another configuration example of the pressure chamber of the liquid supplying device according to at least one embodiment of the present disclosure.

FIG. 11 is a schematic view of another configuration example of the pressure chamber 70 of the liquid supplying device 500 according to at least one embodiment of the present disclosure.

In the example illustrated in FIG. 11, a feeler 401 that is an abutment member is rotatable around a supporting point 400 as its center and, by receiving the force of a spring 402 as an urging unit disposed on the side face of the case 71 of the pressure chamber 70, constantly abuts the flexible film 210. In a case where the ink amount stored in the ink cartridge 23 is small, even when the diaphragm pump 25 is driven, the ink is not delivered, and accordingly, the flexible film 210 does not swell up. When ink droplets are continuously discharged from the recording head 1 in this state, the amount of ink disposed inside the pressure chamber 70 decreases, and the flexible film 210 starts to be gradually recessed. By detecting the recess based on the displacement of the feeler 401 abutting the flexible film 210, a user can be notified of the replacement of the ink cartridge 23. In some embodiments, the displacement of the feeler 401 is detected with a transmission-type photo sensor.

In addition, in the case of this configuration example, when the ink has run out after an image formation (printing) operation is continued until the flexible film 210 is completely recessed, the ink cartridge 23 is replaced in a state in which the pressure of the inside of the pressure chamber 70 is lowered. When the ink cartridge 23 is detached for replacement, the valve 28 is opened in accordance the detachment. However, since the pressure of the pressure chamber 70 is low, the negative pressure occurring in the upstream-side ink supply channel part 90 on the ink cartridge 23 side is not negated, and there is concern that bubbles may be mixed in.

Thus, in this configuration example, a state in which the flexible film 210 starts to be gradually recessed from the state in which the flexible film 210 swells up is set as a threshold, and, when the feeler 401 is lower than the threshold, the ink cartridge 23 is expected to be replaced. By configuring as such, since the ink cartridge 23 can be replaced in the state in which positive pressure remains inside the pressure chamber 70, the negative pressure occurring in the upstream-side ink supply channel part 90 can be negated, whereby bubbles can be prevented from being mixed into the inside of the channel.

In addition, according to the configuration described above, the user can be appropriately notified of the timing when the ink runs out, and, the bubbles can be prevented from being mixed into the upstream-side ink supply channel part 90 when the ink cartridge 23 is detached.

Furthermore, between a case where the ink cartridge 23 is replaced in the state in which the flexible film 210 starts to be recessed and a case where the ink cartridge 23 is replaced in the state in which the flexible film 210 is completely recessed, there is no difference that the ink remaining amount inside the ink cartridge 23 is zero. Thus, when the ink cartridge 23 is replaced in the state in which the flexible film 210 starts to be recessed, the ink remaining amount inside the ink cartridge 23 is zero, and the ink stored inside the ink cartridge 23 can be efficiently used up.

In the above-described embodiments, an image forming apparatus discharges droplets from droplet discharge heads to land the droplets on a recording medium to form an image on the recording medium. However, in some embodiments, the teachings of the present disclosure is applicable to a droplet discharge device other than such an image forming apparatus having the droplet discharge head. For example, in some embodiments, a recording medium onto which droplets for image formation are landed and applied is a medium (a recording medium, a transfer material, or a recording sheet)

other than a sheet of paper, such as string, fiber, cloth, leather, metal, plastic, glass, timber, and ceramic. In some embodiment, the teachings of this disclosure is applied to a device that provides not only meaningful images such as characters and figures but meaningless images such as patterns to the medium, in other words, a device that simply discharges droplets). In some embodiments, the teachings of this disclosure is applied to a droplet discharge device that discharges liquid resist for patterning to land the resist on a medium. In some embodiments, the teachings of this disclosure is applied to a droplet discharge device that discharges liquid resist for patterning to land the resist on a medium. In some embodiments, the teachings of this disclosure is applied to a droplet discharge device that discharges a genetic analysis sample to land on a medium or a droplet discharge device for a three-dimensional modeling.

The above description relates to limited examples, and, for example, aspects of the present invention have advantages as follow.

(Aspect A)

There is provided a liquid supplying device including: a container mount portion, such as a cartridge holder 24, to which a liquid container, such as an ink cartridge 23, is detachably mountable; a liquid supply channel, such as a liquid supply channel 22, to communicate with both the liquid container mounted in the container mount portion and a liquid supply target, such as a recording head 1; a liquid feeder, such as a diaphragm pump 25, at a midway of the liquid supply channel to feed liquid, such as ink, in the liquid supply channel to the liquid supply target by pressurizing the liquid; a bypass channel, such as a bypass channel 29, connected to the liquid supply channel to bypass a portion of the liquid supply channel and communicate with both an upstream side and a downstream side of the liquid feeder in a liquid supply direction of the liquid supply channel; and a first valve, such as a valve 28, in the bypass channel to close when the liquid container is mounted in the container mount portion and to open in response to detachment of the liquid container. According to this aspect, as described in the above-described embodiments, the bypass channel communicates with both the upstream side and the downstream side of the liquid feeder in the liquid supply direction of the liquid supply channel communicating with the liquid container and the liquid supply target and to bypass the liquid supply channel. In this bypass channel, the first valve that is opened or closed as follows is disposed. When the liquid container mounted in the container mount portion is detached, the first valve in the bypass channel is opened according to detachment of the liquid container. Accordingly, the bypass channel is opened, and the liquid in a downstream-side channel part of the liquid feeder in the liquid supply direction of the liquid supply channel becomes movable to a liquid container-side channel part on the upstream side of the liquid feeder in the liquid supply channel, through the bypass channel. Thus, even when the liquid container-side channel part, which is on the upstream side of the liquid feeder in the liquid supply channel, is in a negative pressure state by a liquid feed operation according to the pressurizing performed by the liquid feeder, the negative pressure is alleviated in accordance with movement of the liquid from the downstream-side channel part of the liquid feeder to the upstream-side channel part. Accordingly, entering of bubbles into the liquid supply channel can be suppressed. In addition, the valve disposed in the bypass channel is closed when the liquid container is mounted in the container mount portion. Thus, the bypass channel is closed, and the liquid disposed in the downstream-side channel part of the liquid feeder that is pressurized by the liquid feeder in the liquid supply channel does not leak into the liquid container-side channel part that is on the upstream side of the liquid feeder in the liquid supply channel through the bypass channel. Accordingly, the liquid disposed in the downstream-side channel part of the liquid feeder that is pressurized by the liquid feeder in the liquid supply channel can be supplied to the liquid supply target. As above, the liquid can be supplied to the liquid supply target by pressurizing the liquid, and the entering of the air into the liquid supply channel can be suppressed when the liquid container is detached.

(Aspect B)

In the aspect A described above, the liquid supplying device further includes a relay chamber, such as a pressure chamber 70, to store the liquid between the liquid feeder and the liquid supply target in the liquid supply channel and including a side wall portion at least partially having a flexible film, such as a flexible film 210, and a second valve, such as a valve 64, between the relay chamber and the liquid supply target in the liquid supply channel to open when pressure of the liquid on a liquid supply target side of the liquid supply channel is lowered and to close otherwise. The bypass channel, such as the bypass channel 29, is connected to the liquid supply channel to communicate with both a portion of the liquid supply channel between the liquid feeder and the liquid container and a portion of the liquid supply channel between the liquid feeder and the second valve. According to this aspect, as described in the above-described embodiments, the pressure of the liquid, which is raised by pressurizing of the liquid feeder, is stabilized, and an excessive rise of the pressure of the liquid supplied to the liquid supply target side can be prevented.

(Aspect C)

In Aspect A or B described above, the liquid supplying device further includes a sealing unit to close a liquid receiving port, such as a communication port 177, of the liquid supply channel when the liquid container is detached. The container mount portion allows a liquid ejection port, such as a liquid ejection port 23*a*, of the liquid container and the liquid receiving port, such as the communication port 177, of the liquid supply channel to communicate with each other when the liquid container is mounted in the container mount portion. According to this aspect, as described in the above-described embodiments, the leakage of the liquid to the outside due to pressure delivered through the bypass channel can be prevented. Accordingly, a user's hand is prevented from getting dirty by the liquid leaking from the liquid supplying device, and the device can be further protected.

(Aspect D)

In any one of Aspects A to C described above, an urging unit, such as a spring 215, to urge the flexible film to an inward direction of the relay chamber in the relay chamber is further included. According to this aspect, as described in the above-described embodiments, when the liquid container is detached, in a case where the first valve, such as the valve 28, of the bypass channel, such as the bypass channel 29, is open, the pressure of the liquid at the downstream side of the liquid feeder in the liquid supply channel is delivered to the upstream side of the liquid feeder through the bypass channel so as to be in a balanced state. At this time, by urging the flexible film, such as the flexible film 210, of the relay chamber in the inward direction of the relay chamber, the pressure that is in the balanced state is securely positive pressure, and the pressure of the liquid at the upstream side of the liquid feeder in the liquid supply channel can be reliably higher than the atmospheric pressure. Accordingly, the entering of the air into the liquid supply channel when the liquid container is detached can be prevented more reliably.

(Aspect E)

In any one of Aspects A to D described above, the bypass channel, such as the bypass channel 29, at least partially has a flexible channel, such as a flexible channel 29*a*. The first valve, such as the valve 28, in the bypass channel is configured to close as the flexible channel is pressurized by the liquid container when the liquid container is mounted and to open as the pressurizing of the flexible channel is released in response to detachment of the liquid container. According to this aspect, as described in the above-described embodiments, the cost of the device can be less than that of a case where the first valve, such as the valve 28, is configured by using a solenoid valve or the like so as to be controlled by a controller.

(Aspect F)

In any one of Aspects A to E described above, the bypass channel, such as the bypass channel 29, is filled with the liquid by driving the liquid feeder when the liquid container is detached. According to this aspect, as described in the above-described embodiments, in a case where air or a filling liquid other than a predetermined liquid is present in the bypass channel, in the state in which the liquid container is detached, the air or the filling liquid of the bypass channel can be removed, and the bypass channel can be filled with the predetermined liquid. As above, since the liquid container can be mounted in the state in which the bypass channel is filled with the predetermined liquid by removing the air or the filling liquid of the bypass channel, the entering of the air into the liquid supply channel at the time when the liquid container is detached can be prevented more reliably.

(Aspect G)

In any one of Aspects A to F described above, the liquid feeder is a diaphragm pump, such as a diaphragm pump 25. According to this aspect, as described in the above-described embodiments, without using a complex control device, an excessive increase in the pressure of the liquid supplied to the liquid supply target is suppressed, and the liquid that is pressurized in a predetermined pressure range can be supplied to the liquid supply target.

(Aspect H)

In any one of Aspects A to G described above, a detector that abuts the flexible film, such as a flexible film 210, formed in the relay chamber and detects a displacement of the flexible film is further included. According to this aspect, as described in the above-described embodiments, timing when there is no liquid inside the liquid container and timing when the liquid is decreasing can be reliably detected, and a user or the like can be notified of such timings.

(Aspect I)

In any one of Aspects A to H described above, when the liquid container is to be detached, the liquid container is detached after the first valve, such as the valve 28, disposed in the bypass channel, such as the bypass channel 29, is opened first. According to this aspect, as described in the above-described embodiments, before the liquid container is detached, the negative pressure of the liquid container-side channel part that is on the upstream side of the liquid feeder in the liquid supply channel can be reliably alleviated.

Accordingly, the entering of the air into the liquid supply channel when the liquid container is detached can be prevented more reliably.

(Aspect J)

There is provided a droplet discharge device including: a droplet discharge head such as a recording head 1 that has nozzles to discharge droplets; and the liquid supplying device that supplies a liquid to the droplet discharge head according to any one of Aspects A to I described above. According to this aspect, as described in the above-described embodiments, the liquid used for discharging liquid droplets is pressurized and can be reliably supplied to the droplet discharge head. Accordingly, the insufficient supply of the liquid to the droplet discharge head is avoided, and the droplet discharge characteristics can be stabilized. In addition, the entering of the air into the liquid supply channel can be suppressed when the liquid container is detached, and accordingly, the droplet discharge characteristics can be further stabilized.

(Aspect K)

There is provided an image forming apparatus including: a droplet discharge head such as a recording head 1 that has nozzles to discharge droplets for image formation toward a recording medium; and the liquid supplying device that supplies a liquid for image formation such as ink to the droplet discharge head according to any one of Aspects A to I described above. According to this aspect, as described in the above-described embodiments, the liquid used for discharging liquid droplets used for forming an image is pressurized and can be reliably supplied to the droplet discharge head. Accordingly, the insufficient supply of the liquid to the droplet discharge head is avoided, and the droplet discharge characteristics can be stabilized, whereby degradation of the image quality can be prevented. In addition, the entering of the air into the liquid supply channel at the time when the liquid container is detached can be prevented, and accordingly, the droplet discharge characteristic can be further stabilized, whereby the degradation of the image quality can be prevented more reliably.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid supplying device comprising:

a container mount portion to which a liquid container is detachably mountable;

a liquid supply channel to communicate with both the liquid container mounted in the container mount portion and a liquid supply target;

a liquid feeder at a midway of the liquid supply channel to pressurize a liquid in the liquid supply channel to feed the liquid to the liquid supply target by pressurizing the liquid;

a bypass channel connected to the liquid supply channel to bypass a portion of the liquid supply channel and communicate with both an upstream side and a downstream side of the liquid feeder in a liquid supply direction of the liquid supply channel; and a first valve in the bypass channel to close when the liquid container is mounted in the container mount portion and to open in response to detachment of the liquid container.

2. The liquid supplying device according to claim 1, further comprising:

a relay chamber to store the liquid between the liquid feeder and the liquid supply target in the liquid supply channel, the relay chamber including a side wall portion at least partially having a flexible film; and a second valve between the relay chamber and the liquid supply target in the liquid supply channel to open when pressure of the liquid in a liquid supply target side of the liquid supply channel is lowered and to close otherwise, wherein the bypass channel connected to the liquid supply channel to communicate with both a portion of the liquid supply channel between the liquid feeder and the liquid container and a portion of the liquid supply channel between the liquid feeder and the second valve.

3. The liquid supplying device according to claim 2, further comprising an urging unit to urge the flexible film to an inward direction of the relay chamber.

4. The liquid supplying device according to claim 2, further comprising a feeler to abut the flexible film of the relay chamber to detect a displacement of the flexible film.

5. The liquid supplying device according to claim 1, further comprising a sealing unit to close a liquid receiving port of the liquid supply channel when the liquid container is detached from the container mount portion, wherein the container mount portion is configured to communicate a liquid ejection port of the liquid container with the liquid receiving port of the liquid supply channel when the liquid container is mounted in the container mount portion.

6. The liquid supplying device according to claim 1, wherein the bypass channel at least partially having a flexible channel, and wherein the first valve in the bypass channel is configured to close as the flexible channel is pressurized by the liquid container when the liquid container is mounted and to open as the pressurizing of the flexible channel is released in response to detachment of the liquid container.

7. The liquid supplying device according to claim 1, wherein the bypass channel is filled with the liquid by driving the liquid feeder when the liquid container is detached from the container mount portion.

8. The liquid supplying device according to claim 1, wherein the liquid feeder is a diaphragm pump.

9. The liquid supplying device according to claim 1, wherein the liquid container is detached from the container mount portion after the first valve in the bypass channel is opened.

10. A droplet discharge device, comprising:

a droplet discharge head including a nozzle to discharge droplets of a liquid; and the liquid supplying device according to claim 1 to supply the liquid to the droplet discharge head.

11. An image forming apparatus, comprising:

a droplet discharge head including a nozzle to discharge droplets of a liquid for image formation toward a recording medium; and the liquid supplying device according to claim 1 to supply the liquid for image formation to the droplet discharge head.

* * * * *